United States Patent [19]

Yuhas et al.

[11] Patent Number: 4,653,228

[45] Date of Patent: Mar. 31, 1987

[54] WINDOW OPERATING APPARATUS

[75] Inventors: Ralph G. Yuhas; William H. Birmingham, both of Helena, Mont.

[73] Assignee: Win-Trol, Inc., Helena, Mont.

[21] Appl. No.: 722,847

[22] Filed: Apr. 12, 1985

[51] Int. Cl.[4] ..... E05F 11/00

[52] U.S. Cl. ..... 49/357; 74/606 R

[58] Field of Search ..... 49/357, 325, 340; 74/606

[56] References Cited

U.S. PATENT DOCUMENTS

| | | | |
|---|---|---|---|
| 3,452,479 | 7/1969 | Bentley | 49/357 X |
| 3,456,387 | 7/1969 | Tolson | 49/357 X |
| 3,717,954 | 2/1973 | Scheckells | 74/606 X |

*Primary Examiner*—Kenneth Downey

[57] ABSTRACT

Window operating apparatus includes a housing portion, a support portion, a drive portion, a power supplying portion and a mounting portion. The housing portion includes a base section and a cover member disposed over the base section including a top section and sidewall sections extending downwardly from peripheral edges thereof engageable with the base section. The support portion includes opposed upwardly extending end sections. The drive portion which is supported between the end sections and secured thereto includes a gear train disposed adjacent the top section, the gear train including meshing gear members rotatable in a plane substantially parallel to the top section. An electrical motor affixed below one end of the gear train adjacent the base section includes an output shaft extending upwardly from the motor and engaging one of the gear members in the gear train. A second shaft member engages the other of the meshing gear members and extends downwardly from the gear train through an opening in the base section. A socket is disposed on the free end of the second shaft member outside the housing portion. The mounting portion includes a bracket member with a plate section disposed adjacent one of the upstanding end sections and affixed thereto extending outwardly through a slot in the base section and a foot at the end thereof.

19 Claims, 5 Drawing Figures

FIG. 3
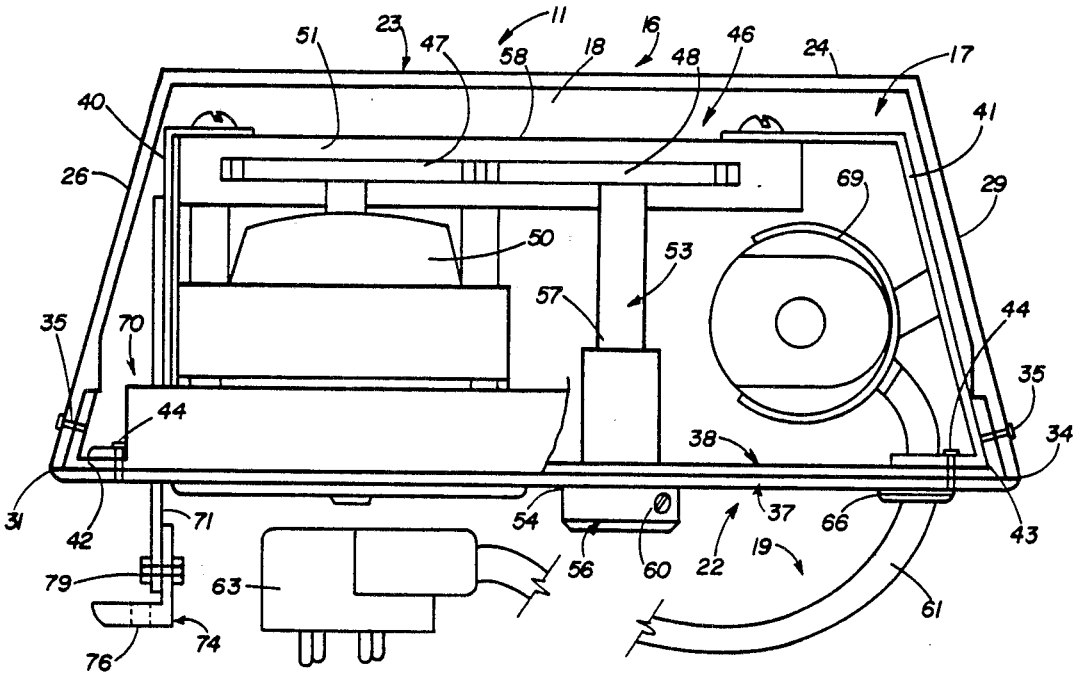
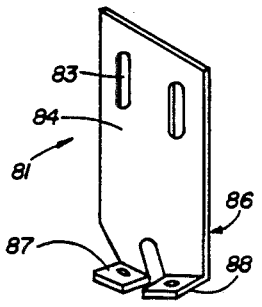
FIG. 4
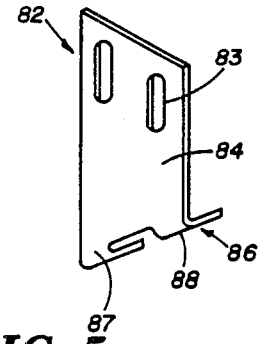
FIG. 5

WINDOW OPERATING APPARATUS

This invention relates to a novel window apparatus and more particularly relates to a new apparatus for opening and closing windows.

Windows have been utilized in buildings for many centuries. These windows have utilized a wide variety of designs. Some are fixed glass whose sole function is to allow light into the building. However, most windows are movable to allow ventilation as well as to permit light to enter.

Many movable windows are hinged along one edge so the window sash can be pushed outside the casing or pulled inside depending upon the design. Other windows include two or more sashes disposed in adjacent planes. Eash sash is in a separate track with one sash sliding in front or behind the companion sash.

Such windows ordinarily are opened and closed manually by applying force to the sash being moved. Through the years, various mechanisms have been developed to simplify movement of windows. Some of these devices are for the purpose of locking the window in a closed position. Others are to lock the window in a partially open position as well. Still others assist in the opening and closing thereof. A few of the mechanisms function both to lock and also to facilitate the opening and closing.

One device that is commonly employed especially on higher quality windows is the crank mechanism. It generally includes a crank handle inside the building adjacent the window that controls the position of an arm having its free end pivotally attached to a hinged window. Rotating the handle causes the arm to extend or retract. Since the end of the arm is attached to a movable window sash, the free edge of the hinged sash will be moved away from the window casing to provide an open space for the movement of air therethrough.

Crank actuated window-control mechanisms have functioned successfully in a variety of installations for many years. However, the success of their operation is dependent upon the individual performing the opening and closing operations since the mechanism only functions when a person actuates it. Problems arise when windows are not readily accessible and/or the persons responsible for operating the windows at the appropriate time are unable or unwilling to do it. This may be due to lack of time and motivation or physical limitations and disabilities.

With windows that are inaccessible because of location, opening and closing of the windows may be a difficult task even if a person is willing to assume the task. This situation commonly occurs when windows are placed high above the floor such as clerestory windows, which may require a ladder and/or a long pole to open and close them.

In determining window placement, an architect may have focused his attention on aesthetics and not give sufficient consideration to convenience of operation. Also, a building owner may underestimate the time that will be required to open and close the windows on a regular basis in deciding on structural features of a future building or when inspecting a building for purchase.

Neglecting to close windows at the required time can result in significant heat loss or even worse, wind, rain or snow may blow through an open window into a building damaging its furnishings or contents.

If an owner is unwilling or incapable of diligently performing the task, he simply will discontinue opening windows that are not within easy reach. This course of action may create problems if the room does not have a sufficient number of windows that are within easy reach and can be opened easily for ventilation. Where the number of openable windows in a room is limited, the air in the room may become stale and contaminated with offensive odors. In such circumstances, an individual may have to endure the situation with a great deal of frustration and ill temper.

It has been proposed to use electrical motors to open and close windows where manual operation is not feasible. Devices have been designed to be mounted on the window casing and connected to the window control. In the past, motors for operating windows were relatively large in size and presented an objectionable appearance, particularly in homes. Some devices could not receive Underwriter's Laboratory approval because they could not be operated safely should the mechanisms be exposed to moisture such as might be encountered if a window were not closed when it was raining or snowing.

Another drawback of motorized window controls was the high price thereof which limited their use. Another serious shortcoming of motorized controls was the difficulty encountered in installing them on nonstandard windows. Custom hardware and installation would further increase the cost.

From the above discussion, it is clear that previous motorized controls for windows were not satisfactory in many applications. Thus, an owner was faced with the dilemma of not opening inaccessible windows manually or purchasing a motor control which was not pleasing in appearance and relatively expensive. Even if the installation could be justified on other grounds, the control still might be damaged or cause damage if exposed to the moisture that normally can be expected with any movable window.

The present invention provides a novel window operating apparatus with features and advantages not found in previous devices and methods. The window operating apparatus of the invention provides control of the operation of windows that otherwise would be inaccessible either because of remoteness of location or because of physical limitations or disability. The apparatus is not affected by moisture and thus can be operated safely even if accidentally exposed to rain or snow. The apparatus is low in profile and is aesthetically pleasing in appearance.

The window operating apparatus of the invention is simple in design and can be produced relatively inexpensively. Commercially available materials and components can be utilized in its manufacture. Conventional electrical and mechanical fabrication techniques and procedures can be employed with semi-skilled labor.

The apparatus can be installed on a crank mechanism of a window easily and quickly. The apparatus can be operated easily with switches positioned for convenient use adjacent the window or at remote points in a central panel. The apparatus is adaptable to a wide variety of different window designs and configurations. The apparatus can be utilized in combination with time, sequence, climate and other controls to afford automatic operation of windows.

These and other benefits and advantages of the novel window operating apparatus of the present invention will be apparent from the following description and the accompanying drawings in which:

FIG. 3 is a view in perspective of the window operating apparatus shown in FIG. 1 with parts separated;

FIG. 4 is a view in perspective of another form of the mounting portion of the window operating apparatus of the invention; and FIG. 5 is a view in perspective of a further form of the mounting portion of the window operating apparatus of the invention.

Figure 1:
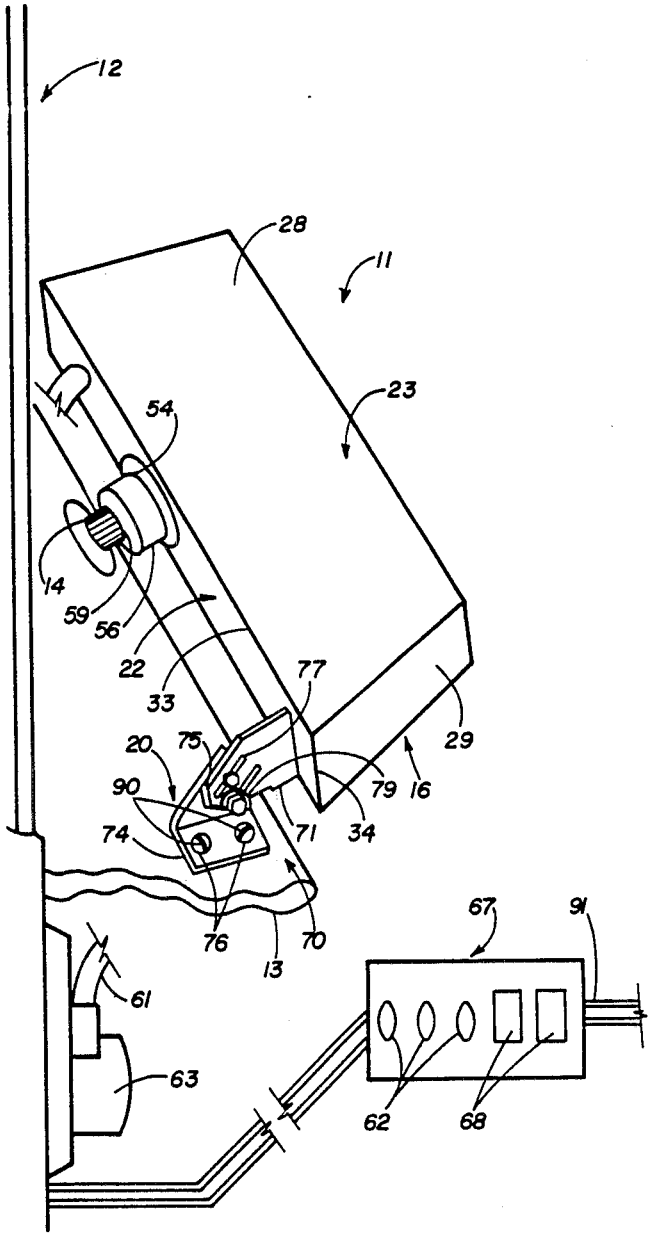
FIG. 1 is a view in perspective of one form of the window operating apparatus of the invention mounted on a window.

As shown in the drawings, one form of the novel window operating apparatus 11 of the present invention is mounted on a window 12 that includes a casing 13 and a control mechanism with a stud drive spline 14. The window operating apparatus 11 of the invention includes a housing portion 16, a support portion 17, a drive portion 18, a power supplying portion 19 and a mounting portion 20.

The housing portion 16 of the window operating apparatus 11 of the present invention includes a base section 22 and a cover member 23 disposed over the base section. The cover member 23 includes a top section 24 and sidewall sections 26, 27, 28 and 29. The sidewall sections 26–29 include free edges 31, 32, 33 and 34 remote from the top section 24. The free edges 31–34 are engageable with the base section 22. The cover member 23 advantageously is secured to the base section with suitable fasteners such as screws 35. Preferably, the base section 22 includes an outer plastic member 37 and an inner metal member 38.

The support portion 17 of the window operating apparatus 11 of the invention includes opposed upwardly extending end sections 40 and 41. The end sections 40 and 41 extend upwardly from adjacent opposite ends 42 and 43 of the base section 22. The end sections extend upwardly within the housing portion 16 to adjacent the top section 24 of the cover member 23. Advantageously, the end sections 40 and 41 are affixed to the base section with suitable fasteners such as rivets 44.

The drive portion 18 of the window operating apparatus 11 is supported between the end sections 40 and 41 and secured to such sections. The drive portion includes a gear train 46. The gear train 46 includes intermeshing gear members 47 and 48. The gear members are rotatable in a plane substantially parallel to the top section 24.

The drive portion 18 also includes an electrical motor 50 affixed below one end 51 of the gear train adjacent the base section 22. The motor 50 includes an output shaft 52 which extends upwardly from the motor and engages one of the gear members 47 disposed within the gear train.

A second shaft member 53 engages the other gear member 48. The second shaft extends downwardly from the gear train through an opening 54 in the base section 22. Socket means 56 is disposed on the free end 57 of the second shaft member 48 located outside the housing portion 16.

The gear train 46 advantageously includes an elongated enclosure 58 for the gear members 47 and 48. Preferably, the first and second shaft members 52 and 53 are disposed parallel to one another and spaced from each other. The socket 56 advantageously includes an internal gripping surface 59 and a set screw 60 to provide a positive interconnection with the stud drive spline 14 of the window control. The upper end of the drive portion 18 preferably is secured to the upper ends of the end sections 40 and 41.

The power supplying portion 19 of the window operating apparatus 11 of the invention includes electrical conductor means 61. The electrical conductor means is connected to the motor 50 and to switch means 62 associated therewith. The electrical conductor 61 advantageously includes a plug connection 63 at the end thereof remote from the motor 50.

The electrical conductor means 61 extends through an opening 65 in the base section 22. The opening 65 as well as the opening 54 for the second shaft member 48 preferably includes sealing means such as gaskets 66. The switch means 62 advantageously is located remotely from the apparatus such as at a control panel 67. In addition to one or more switches, the control panel also may include other control components 68 such as timing elements, climatic condition sensors, sequence programmers and the like.

The power supplying portion 19 also advantageously includes a capacitor 69 when the motor 50 is an AC motor. The capacitor preferably is secured to one end section 41 and located within the housing portion 16.

The mounting portion 20 of the window operating apparatus 11 includes a bracket member 70. The bracket member includes a plate section 71 disposed adjacent one upstanding end section 40. The plate section is affixed to the end section with suitable fasteners 72. The plate section 71 extends outwardly from the housing portion 16 through a slot 73 in the base section 22. Sealing means advantageously also is utilized around the slot 73 and preferably along the edges of the cover member 23.

The mounting portion 20 also includes foot means 74 extending from a free edge 75 of the plate section 71 that is located outside the housing portion 16. The foot means 74 extends from the plate section substantially perpendicular thereto. The foot means includes a plurality of openings 76 therethrough.

Figure 2:
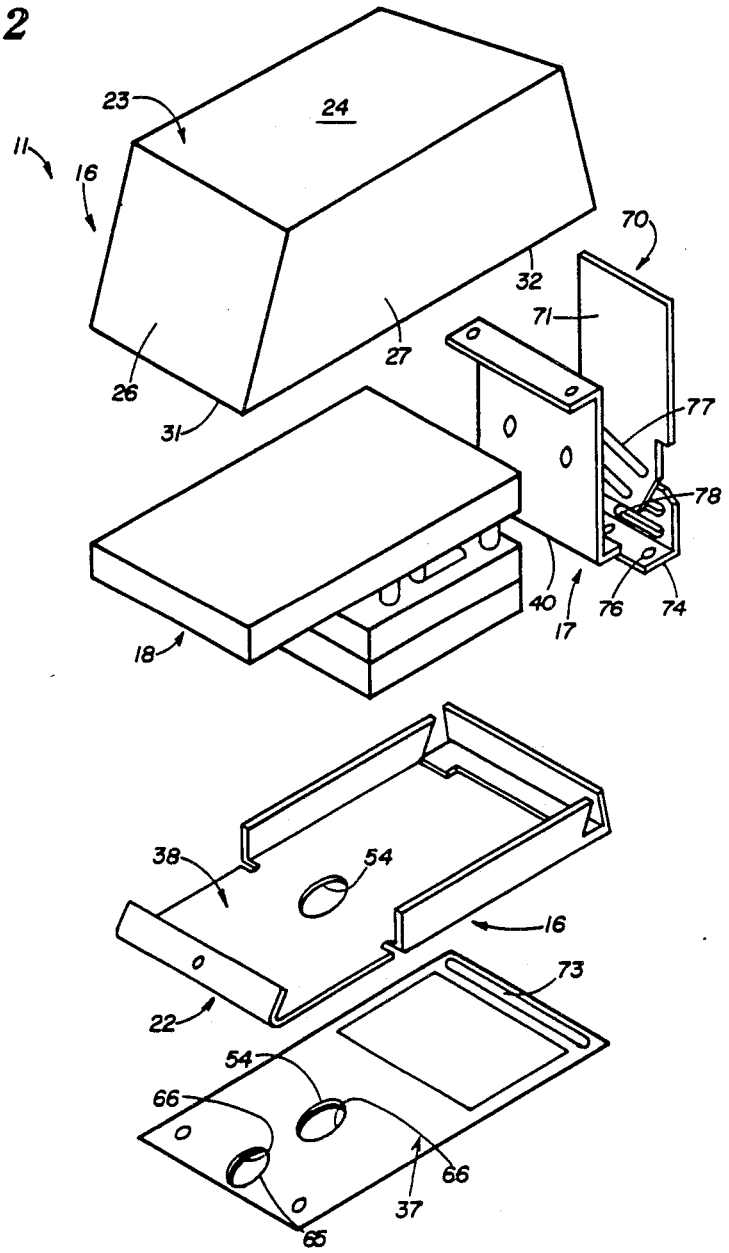
FIG. 2 is an enlarged side view partially in section from the rear of the window operating apparatus shown in FIG. 1.

Advantageously, the foot means 74 of the mounting portion 20 is separable from the plate section as shown in FIGS. 1–3. Both the plate section and the foot means may include overlapping slots 77 and 78 and securing means such as bolts 79. This construction provides a great range of adjustment of the bracket member with respect to the housing portion to facilitate mounting thereof on window casings with many different profiles. Such slot combinations together with different foot designs maximize installation flexibility.

Alternatively, the plate section and the foot means may be formed as a unitary structure such as bracket members 81 and 82 as shown in FIGS. 4 and 5 respectively. Bracket members 81 and 82 include slots 83 in the plate section 84 thereof to provide adjustment with respect to the end section to which it is affixed. The bracket members 81 and 82 also include foot means 86 with two sections 87 and 88. As shown in FIG. 4, the two sections are disposed in different planes to facilitate mounting of the apparatus of the invention on window casings (not shown) that include surfaces in more than one plane.

The components of the window operating apparatus of the present invention may be formed from a wide variety of different materials such as metals, plastics, wood, combinations thereof and the like. Advantageously, the outer components such as cover member 23 and outer base member 37 are molded plastic parts. The inner base member 38 and the upstanding end sections 40 and 41 preferably are metal components.

In the use of the window operating apparatus 11 of the invention as shown in the drawings, the apparatus first is installed on the window 12. A bracket member 70 with a particular foot 74 is selected to match the configuration of the window casing 13. The bracket member 70 is loosely secured to the end section 40 with fasteners 72.

Next, the crank handle (not shown) is removed from the drive spline 14 and the socket 56 on the exposed end 57 of the second shaft member 53 is slipped over the drive spline. The housing portion 16 is oriented with respect to the window casing. The openings 76 in the foot 74 are marked on the casing and the apparatus 11 removed to drill the required holes in the casing. The bracket member 70 is affixed to the window casing with suitable fasteners 90.

Then, the apparatus 11 with the cover member 23 removed is slid into position by inserting plate section 71 of the bracket member through the slot 73 in the base section 22. The socket 56 is slipped over the spline 14 and the set screw 60 tightened. Also, the fasteners 72 secure the plate section 71 to the upper end of the end section 40. When the apparatus is secured to the window casing and the spline, the cover member 23 is replaced and secured with screws 35.

To connect the apparatus 11 electrically, electrical conductor 61 from the motor 50 is connected to a power source of the building. Ordinarily, wires 91 are routed from a circuit breaker box (not shown) of the building to the control panel 67 and/or the switch 62. When the motor is a low voltage motor, a transformer is advantageously included in the circuitry either at the control panel or at the circuit breaker box. The switches 62 preferably are three position devices.

With new buildings, it may be desirable to pre-wire the circuitry for the window controls during construction. In that situation, junction boxes for a switch and/or a control panel can be located adjacent each window or a group so that plug connections 63 can be inserted into suitable sockets at the boxes to complete the circuitry.

In the operation of the window operating apparatus 11, switch 62 is activated to energize capacitor 69 and motor 50. The motor drives output shaft 52 and through gear train 46 rotates second shaft 53 on which socket 56 is affixed. Since socket 56 is in engagement with drive spline 14 of the window control, the window will be moved into an open position. In this way, a window can be opened by an individual who does not have access to the window either because of physical confinement or because the window is located where it cannot be reached.

When it is desired to close the window, switch 62 is activated again in an opposite direction. The motor is activated to drive the spline 14 of the window control in an opposite direction to close the window. These steps can be repeated as required to open and close the window without anyone being in physical proximity to the window.

To provide automatic control of the window, control panel 67 may include control components 68 in addition to switch 62. Such control components may include timing elements to open the window for preselected time intervals at specific times of the day. For more complete control of the window, climatic control sensors for temperature, precipitation, humidity and the like may be included. Also, a group of windows can be opened and closed in a predetermined sequence through a programmer. These components also may be located at each window.

The above description and the accompanying drawings show that the present invention provides a novel window operating apparatus with features and advantages not found in previous devices. The window operating apparatus provides positive control of windows that are inaccessible. Windows that cannot be reached conveniently to open and close can be operated from a location that is accessible even when the window is not. Thus, the apparatus of the invention not only provides control of windows that are spaced from the floor a greater distance than a person can reach, but also enables invalids and persons with physical handicaps to control windows without assistance from others.

The window operating apparatus is simple in design and can be produced relatively inexpensively from commercially available materials and components using conventional manufacturing techniques and semi-skilled labor. The apparatus is durable in construction and has a long useful life with a minimum of maintenance.

The apparatus can be used efficiently by persons of all ages whether or not they possess mechanical aptitude. Since the apparatus operates similarly to the electrcal windows of an automobile, most people can operate it after only a minimum of instruction.

The window operating apparatus can be installed easily and quickly. The apparatus is adaptable to a wide variety of different window designs and configurations. The switches can be located adjacent the window or remote therefrom as desired either singly or in a master panel.

The window operating apparatus of the invention can include controls which enable the window to be opened and closed automatically as outside or inside climatic conditions change. This can be accomplished with various sensors for temperature, moisture, wind velocity and the like. The motor may have the ability to stall for short periods of time without damage if an obstruction is encountered.

It will be apparent that various modifications can be made in the particular window operating apparatus described in detail above and shown in the drawings within the scope of the present invention. The size, configuration and arrangement of components can be changed to meet specific requirements. The housing portion can be painted or otherwise finished to blend with the surroundings. These and other changes can be made in the window operating apparatus provided the functioning and operation thereof are not adversely affected. Therefore, the scope of the present invention is to be limited only by the following claims.

What is claimed is:

1. Window operating apparatus including a housing portion, a support portion, a drive portion, a power supplying portion and a mounting portion; said housing portion including a base section and a cover member disposed over said base section, said cover member including a top section and sidewall sections extending downwardly from peripheral edges of said top section, said sidewall sections having free edges remote from said top section engageable with said base section; said support portion including opposed upwardly extending end sections, said end sections extending upwardly from adjacent opposite ends of said base section, said end sections extending upwardly within said housing portion to adjacent said top section of said cover member; said drive portion being supported between said end sections and secured thereto, said drive portion including a gear train disposed within said housing portion adjacent said top section, said gear train including meshing gear members rotatable in a plane substantially parallel to said top section, an electrical motor affixed below one end of said gear train adjacent said base section, said motor including an output shaft extending upwardly from said motor and engaging one of said gear members of said gear train, a second shaft member engaging the other of said meshing gear members, said second shaft member extending downwardly from said gear train through an opening in said base section, socket means disposed on the free end of said second shaft member outside said housing portion; said power supplying portion including electrical conductor means connected to said motor and switch means associated therewith; said mounting portion including a bracket member, said bracket member including a plate section disposed adjacent one of said upstanding end sections and affixed thereto, said plate section extending outwardly through a slot in said base section, foot means extending substantially perpendicularly from a free edge of said plate section outside said housing portion, said foot means including a plurality of openings therethrough; whereby a window may be opened by engaging said socket means of said drive portion with a stud drive spline of a window operating mechanism, securing said foot means to an adjacent portion of a window casing and connecting electrically said drive portion.

2. Window operating apparatus according to claim 1 wherein said housing portion is formed of plastic.

3. Window operating apparatus according to claim 1 wherein said base section and said cover member of said housing portion are secured together.

4. Window operating apparatus according to claim 1 wherein said base section includes sealing means.

5. Window operating apparatus according to claim 1 wherein said base section includes both an outer plastic member and an inner metal member.

6. Window operating apparatus according to claim 1 wherein said upstanding end sections of said support portion are affixed to said base section.

7. Window operating apparatus according to claim 1 wherein said gear train includes an elongated enclosure for said gear members.

8. Window operating apparatus according to claim 1 wherein said first and second shafts of said drive portion are disposed parallel to but spaced from one another.

9. Window operating apparatus according to claim 1 wherein said socket means includes an internal gripping surface.

10. Window operating apparatus according to claim 1 wherein the upper end of said drive portion is secured to said end sections.

11. Window operating apparatus according to claim 1 wherein said electrical conductor means of said power supplying portion extends through an opening in said base section.

12. Window operating apparatus according to claim 1 wherein said electrical conductor means includes a plug connection.

13. Window operating apparatus according to claim 1 wherein said switch means is located remotely from said apparatus.

14. Window operating apparatus according to claim 1 wherein said power supplying portion includes a capacitor.

15. Window operating apparatus according to claim 14 wherein said capacitor is secured to one of said end sections within said housing portion.

16. Window operating apparatus according to claim 1 wherein said bracket member is adjustable with respect to said end section.

17. Window operating apparatus according to claim 1 wherein said plate section and said foot means of said bracket member are formed as a unitary structure.

18. Window operating apparatus according to claim 1 wherein said foot means of said mounting portion is separable from said plate section thereof.

19. Window operating apparatus according to claim 18 wherein said foot means is adjustable with respect to said plate section.

* * * * *